US011503936B2

(12) United States Patent
Leng

(10) Patent No.: US 11,503,936 B2
(45) Date of Patent: Nov. 22, 2022

(54) MAILBOX FOR STORING PACKAGES

(71) Applicant: New-Tec Integration (Xiamen) Co., Ltd., Fujian (CN)

(72) Inventor: Luhao Leng, Xiamen (CN)

(73) Assignee: New-Tec Integration (Xiamen) Co., Ltd., Fujian (CN)

( * ) Notice: Subject to any disclaimer, the term of this patent is extended or adjusted under 35 U.S.C. 154(b) by 369 days.

(21) Appl. No.: 16/794,165

(22) Filed: Feb. 18, 2020

(65) Prior Publication Data

US 2020/0260896 A1 Aug. 20, 2020

(30) Foreign Application Priority Data

Feb. 18, 2019 (CN) ..... 201920226983.9

(51) Int. Cl.

| | |
|---|---|
| ***A47G 29/124*** | (2006.01) |
| ***A47G 29/20*** | (2006.01) |
| ***A47G 29/30*** | (2006.01) |
| ***A47G 29/22*** | (2006.01) |

(52) U.S. Cl.

CPC ..... *A47G 29/1251* (2017.08); *A47G 29/20* (2013.01); *A47G 29/22* (2013.01); *A47G 29/30* (2013.01); *A47G 29/1248* (2017.08)

(58) Field of Classification Search

CPC ..... A47G 29/20; A47G 29/22; A47G 29/30; A47G 29/1248; A47G 29/1251; A47G 29/12095; A47G 2029/1257

USPC ..... 232/47–51

See application file for complete search history.

(56) References Cited

U.S. PATENT DOCUMENTS 27,466 A * 3/1860 North ..... A47G 29/12095 232/47
132,865 A * 11/1872 Sinclaire ..... A47G 29/12095 43/67
400,299 A * 3/1889 Chappell et al. ..... A47G 29/12095 232/53
413,928 A * 10/1889 Cook ..... A47G 29/1207 43/69
442,983 A * 12/1890 Kinsey ..... A47G 29/12095 232/48
455,373 A * 7/1891 Wesson ..... A47G 29/1225 232/36
465,867 A * 12/1891 Lindsay ..... A47G 29/1201 232/24
741,865 A * 10/1903 Williams ..... A47G 29/12095 232/53

(Continued)

*Primary Examiner* — William L Miller
(74) *Attorney, Agent, or Firm* — Cooper Legal Group LLC

(57) ABSTRACT

The present disclosure discloses mailbox for storing packages comprises a box, at least one tray, and at least one link rod mechanism. The box is a closed box, and the box comprises an upper cover, a bottom board, and a plurality of side boards. A lower portion of one of the plurality of side boards is a movable door configured to be opened and closed. The upper cover is rotatably connected to one of the plurality of side boards and is configured to be upwardly opened. The at least one tray is movably disposed inside the box and is disposed above the movable door, and each of the at least one tray is rotatably connected to at least one of the plurality of side boards. The at least one link rod mechanism is disposed between the at least one tray and the upper cover.

9 Claims, 7 Drawing Sheets

(56) References Cited

U.S. PATENT DOCUMENTS

| | | | | | |
|---|---|---|---|---|---|
| 807,764 | A * | 12/1905 | Mowers et al. | A47G 29/12095 | 232/48 |
| 1,111,031 | A * | 9/1914 | Petri | A47G 29/12095 | 43/67 |
| 4,753,386 | A * | 6/1988 | Phillion, Sr. | A47G 29/121 | 232/17 |
| 5,435,484 | A * | 7/1995 | Carlson | A47G 29/1251 | 232/47 |
| 7,854,374 | B2 * | 12/2010 | Dudley | A47G 29/12095 | 232/47 |
| 10,251,503 | B1 * | 4/2019 | Fulps | A47G 29/12 | |
| 10,368,676 | B1 * | 8/2019 | Ansari | A47G 29/1248 | |
| 11,206,940 | B2 * | 12/2021 | Kaechele | A47G 29/28 | |
| 11,253,094 | B1 * | 2/2022 | Deck | A47G 29/1251 | |
| 11,253,095 | B2 * | 2/2022 | Carlson | A47G 29/16 | |
| 2009/0314828 | A1 * | 12/2009 | Hjorth | A47G 29/1251 | 232/44 |
| 2020/0237132 | A1 * | 7/2020 | Kaechele | A47G 29/141 | |
| 2021/0321809 | A1 * | 10/2021 | Carlson | A47G 29/16 | |

* cited by examiner

MAILBOX FOR STORING PACKAGES

RELATED APPLICATIONS

This application claims priority to Chinese Patent Application 201920226983.9, filed on Feb. 18, 2019, which is incorporated herein by reference.

FIELD OF THE DISCLOSURE

The present disclosure relates to a mailbox, and in particular relates to a mailbox for storing packages.

BACKGROUND OF THE DISCLOSURE

In order to facilitate delivery of packages by couriers, there are fixed mailboxes in many places. The couriers put the packages in the designated mailbox and no longer need to deliver the packages directly to owner. The owner can pick up the packages in the mailbox by himself. This improves efficiency of the delivery.

Existing mailboxes generally have an inlet at a top portion and an outlet at a bottom portion. Both the inlet and the outlet can be locked to prevent the packages from being stolen. The couriers deliver the packages through the inlet, and the owner opens the outlet to pick up the packages. In practice, it is found that the packages fall directly to a bottom of the mailbox after being put into the inlet. Due to the height of the mailbox, the content of the packages is easily damaged during the fall.

BRIEF SUMMARY OF THE DISCLOSURE

The present disclosure provides a mailbox for storing packages to solve deficiencies of the background techniques. In order to solve the aforementioned technical problems, a technical solution of the present disclosure is as follows.

A mailbox for storing packages comprises a box, at least one tray, and at least one link rod mechanism. The box is a closed box, and the box comprises an upper cover, a bottom board, and a plurality of side boards. A lower portion of one of the plurality of side boards is a movable door configured to be opened and closed. The upper cover is rotatably connected to one of the plurality of side boards and is configured to be upwardly opened. The at least one tray is movably disposed inside the box and is disposed above the movable door, and each of the at least one tray is rotatably connected to at least one of the plurality of side boards. The at least one link rod mechanism is disposed between the at least one tray and the upper cover. When the upper cover is opened, the upper cover pulls the at least one link rod mechanism and the at least one link rod mechanism pulls the at least one tray to be turned to a first state for loading at least one package. When the upper cover is closed, the at least one link rod mechanism pushes the at least one tray to be turned to a second state unloading the at least one package.

In another preferred embodiment, the at least one tray is two trays, the two trays are mirror-symmetrically disposed inside the box, and each of the two trays is rotatably connected to an opposite pair of the plurality of side boards.

In another preferred embodiment, each of the at least one link rod mechanism comprises three link rods, and an inner end of each of the three link rods is pivotally connected together. An outer end of the three link rods is respectively pivotally connected to a side of the upper cover, a side of a first tray of the two trays, and a side of a second tray of the two trays.

In another preferred embodiment, at least one positioning hole is respectively disposed on a middle portion of an upper edge of at least one of the plurality of side boards. A first link rod of each of the at least one link rod mechanism hinged to the upper cover passes through a corresponding one of the at least one positioning hole.

In another preferred embodiment, the at least one link rod mechanism comprises two link rod mechanisms, and the two link rod mechanisms are symmetrically disposed on a left side and a right side of the upper cover.

In another preferred embodiment, a reinforcing frame is disposed around edges of each of the plurality of side boards, and each of the at least one positioning hole is disposed on a corresponding one of the reinforcing frames.

In another preferred embodiment, the plurality of side boards comprises four side boards, and each of the two trays is respectively rotatably connected to a front side board and a rear side board of the four side boards.

In another preferred embodiment, the movable door is disposed on the front side board, and the upper cover is rotatably connected to the rear side board.

In another preferred embodiment, the movable door comprises a lock, and the upper cover comprises a lock.

In another preferred embodiment, the upper cover, the bottom board, and the plurality of side boards are plastic boards.

In another preferred embodiment, the first state is a horizontal state, and the second state is a vertical state.

Compared with the background technology, this technical solution has the following advantages:

1. The box comprises at least one tray being rotatable, and the at least one tray is connected to the upper cover by at least one link rod mechanism. When the upper cover is opened, the at least one link rod mechanism pulls the at least one tray to make the at least one tray to be in a horizontal state. When the at least one package is put into the box from a top end of the box, it can be disposed on the at least one tray to prevent the at least one package from falling directly to a bottom of the box. When the cover is gradually closed, the link rod mechanism gradually pushes the at least one tray away. After the upper cover is completely closed, the at least one tray is roughly turned to a vertical state, and the at least one package is dropped into the bottom of the box. As the at least one tray can receive at least one package when the upper cover is open, the at least one tray can effectively prevent the at least one package from falling directly into the bottom of the box and avoid damage to the at least one package.

2. The at least one tray comprises two trays disposed mirror-symmetrically, resulting in the strength of the trays being better and a carrying capacity being stronger.

3. Each of the at least one link mechanism comprises three link rods, and the structure is simple.

4. The plurality of side boards are disposed with at least one positioning hole, which is configured to secure a link rod of a corresponding one of the at least one link rod mechanism to the side board of the box so that the link rod mechanism will not swing when moving.

BRIEF DESCRIPTION OF THE DRAWINGS

The present disclosure will be further described below with the combination with the accompanying drawings and the embodiments.

DETAILED DESCRIPTION OF THE EMBODIMENTS

Embodiment 1

Figure 1:
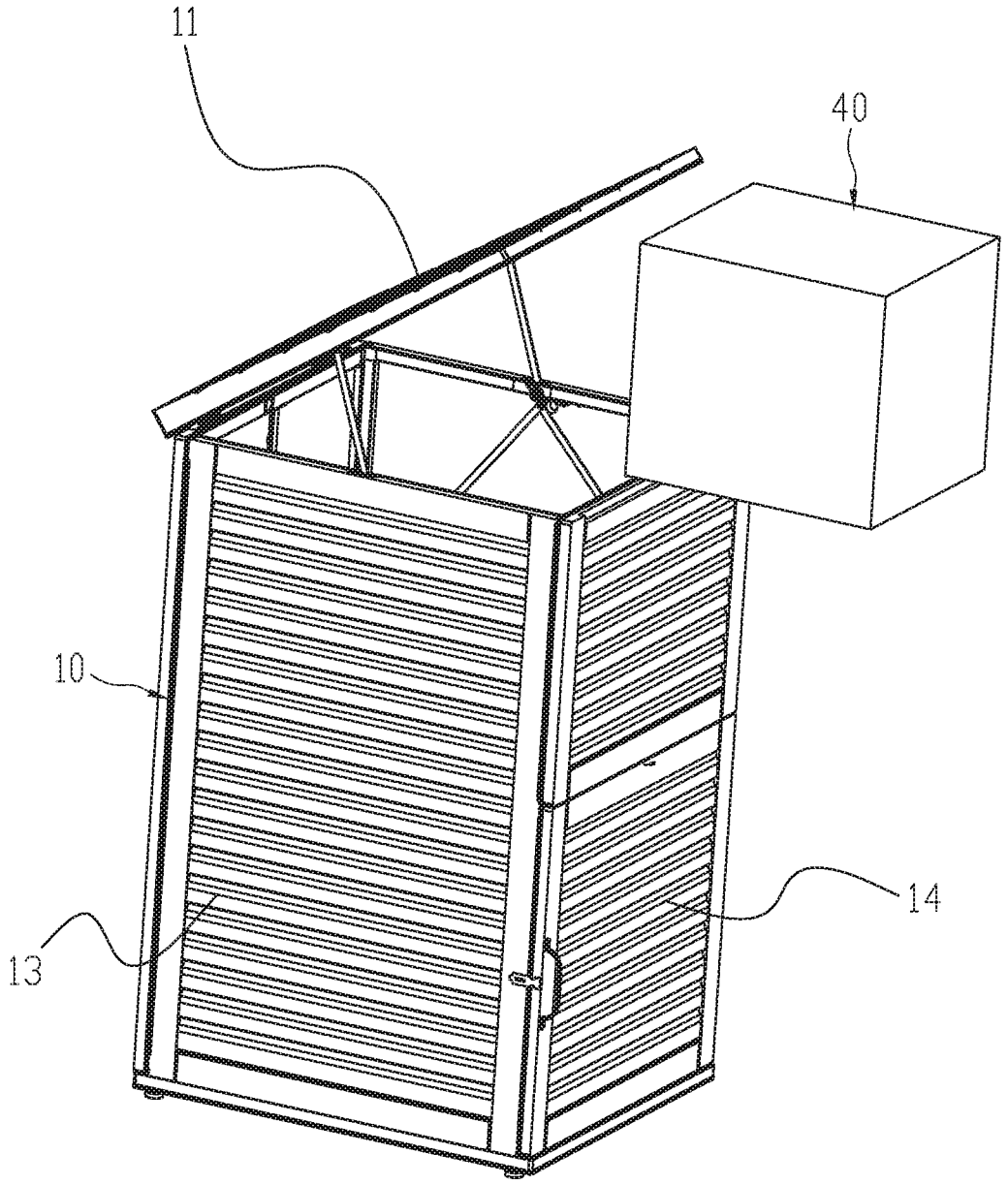
FIG. 1 illustrates a perspective view of a mailbox for storing packages of Embodiment 1 of the present disclosure when an upper cover is open.
Figure 2:
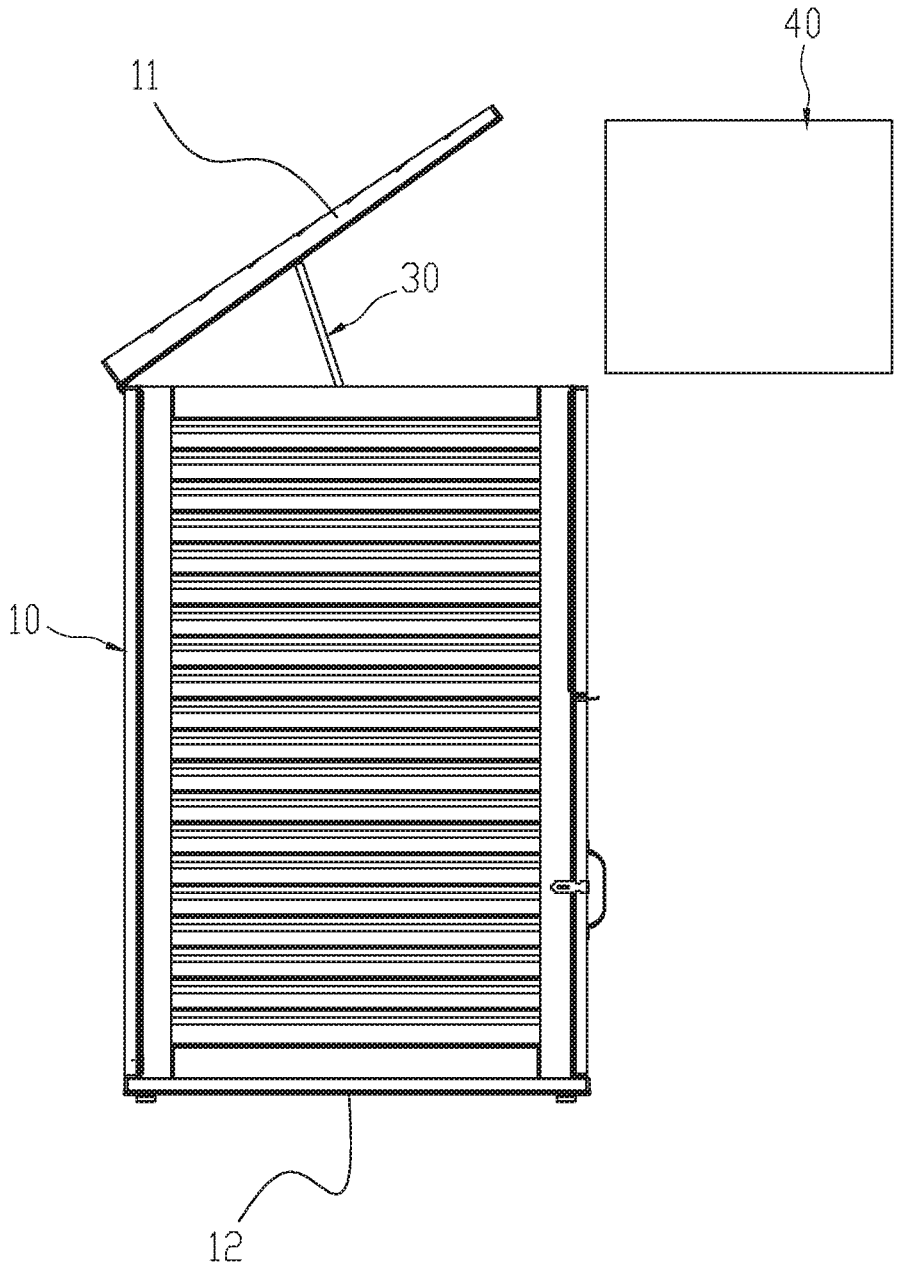
FIG. 2 illustrates a side view of the mailbox for storing packages in FIG. 1 when the upper cover is open.
Figure 3:
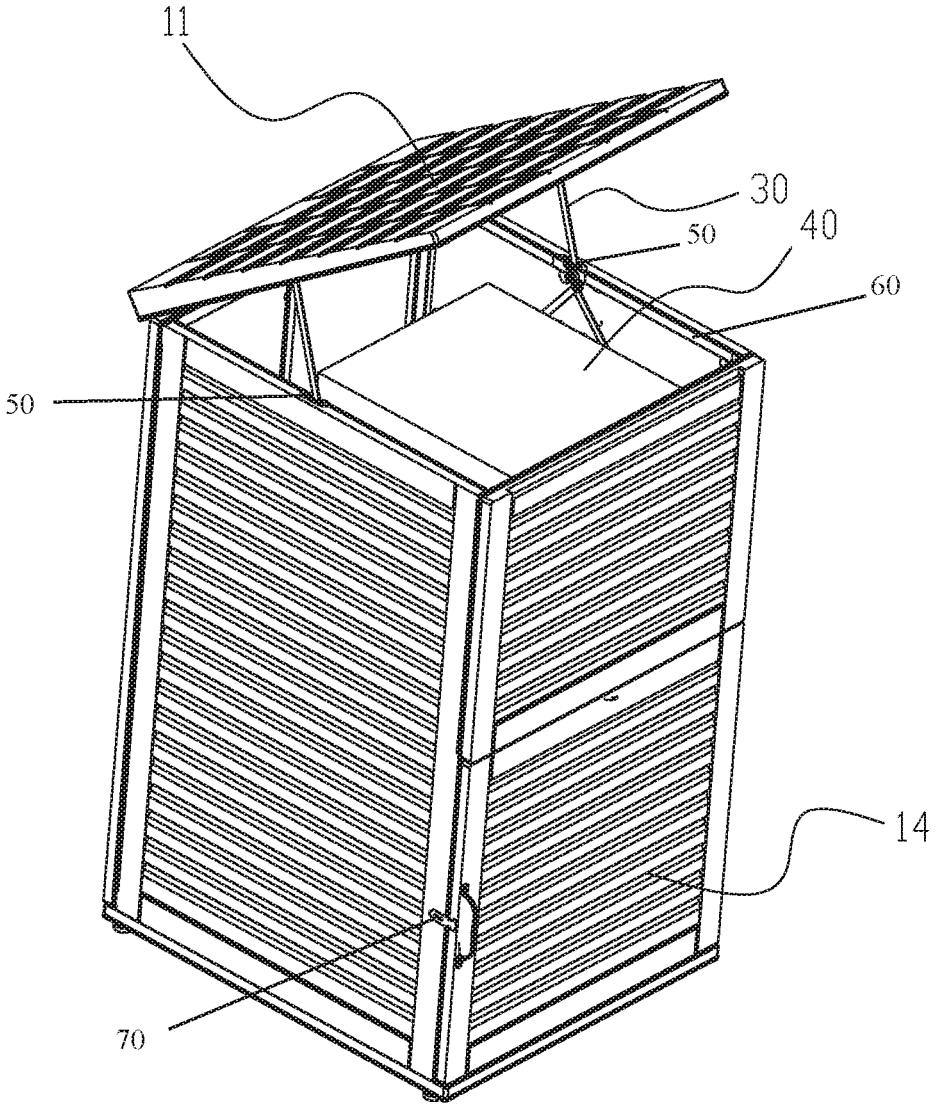
FIG. 3 illustrates a perspective view of the mailbox for storing packages in FIG. 1 when a tray of the mailbox for storing packages receives a package.
Figure 4:
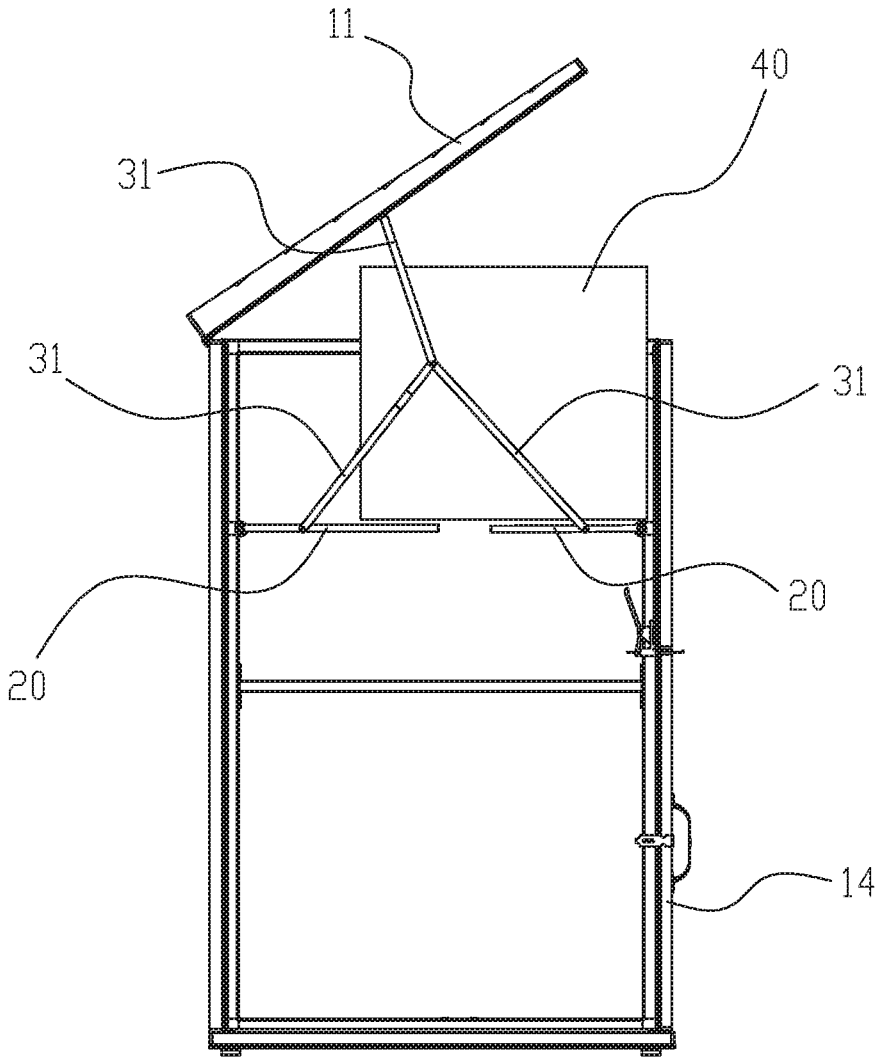
FIG. 4 illustrates a schematic view of an internal structure of the mailbox for storing packages in FIG. 1 when the tray of the mailbox for storing packages receives the package.
Figure 5:
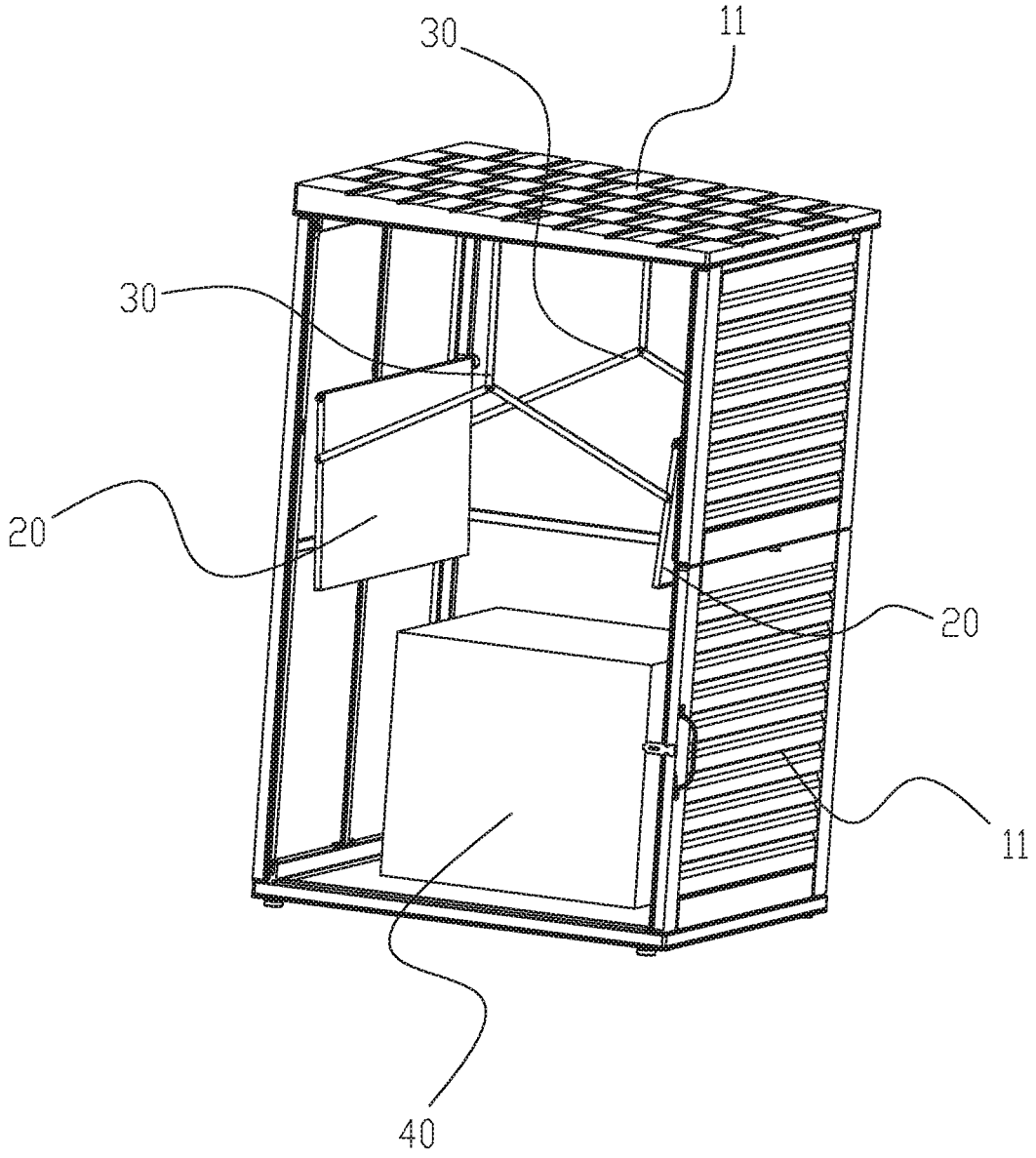
FIG. 5 illustrates a first schematic view of the mailbox for storing packages in FIG. 1 when the upper cover is closed.
Figure 6:
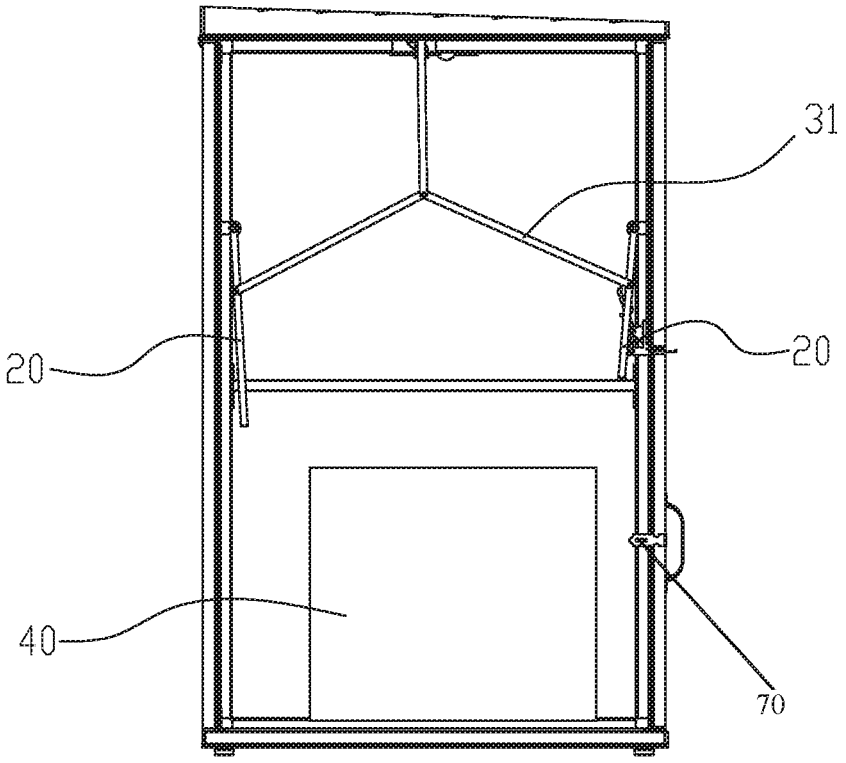
FIG. 6 illustrates a second schematic view of the mailbox for storing packages in FIG. 1 when the upper cover is closed.
Figure 7:
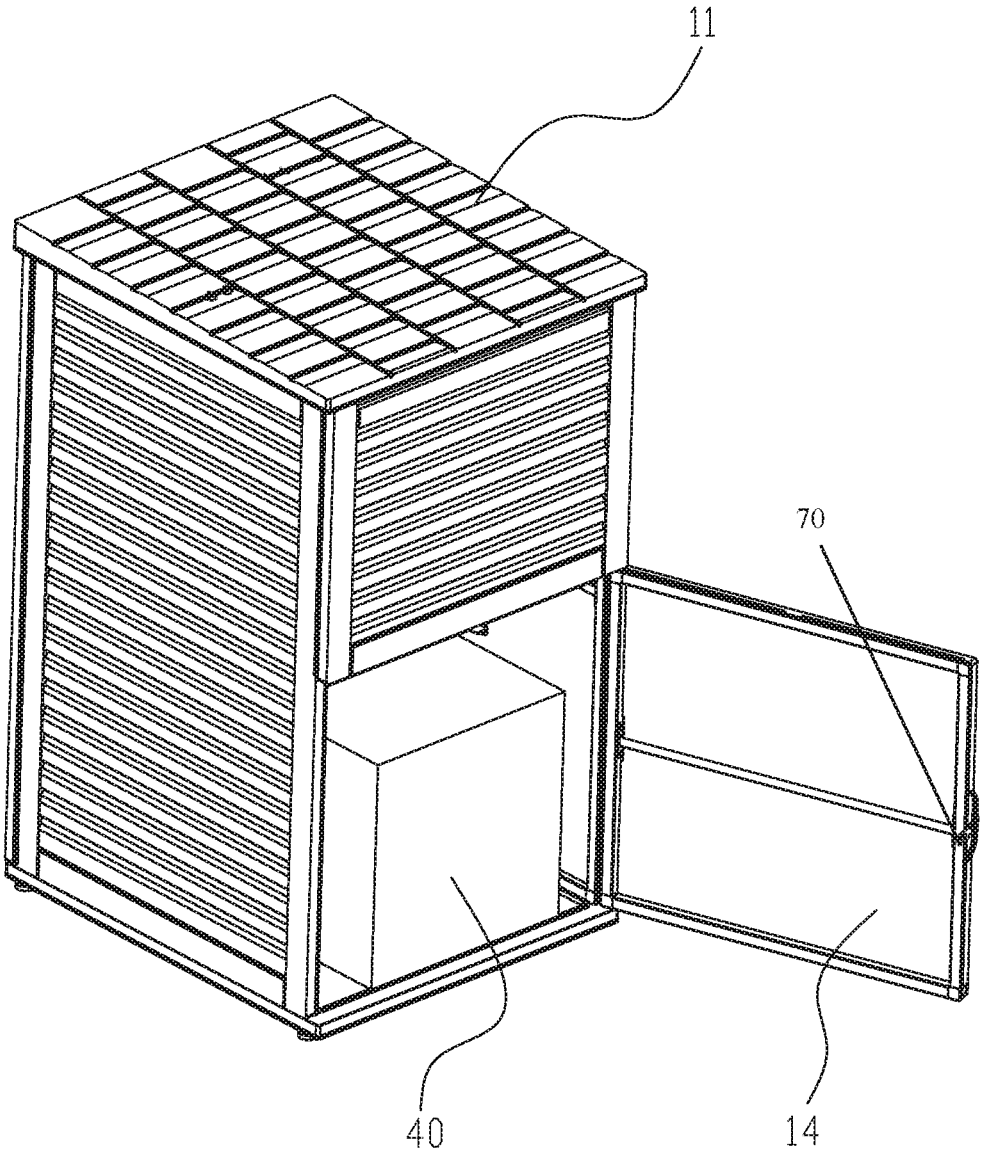
FIG. 7 illustrates a perspective view of the mailbox for storing packages in FIG. 1 when the movable door is open.

Referring to FIGS. 1-7, a mailbox for storing packages comprises a box 10. The box 10 is a closed box and comprises an upper cover 11, a bottom board 12, and four side boards 13. The four side boards 13 comprise a front side board 13, a rear side board 13, a first lateral side board 13, and a second lateral side board 13. A lower portion of the front side board 13 is a movable door 14 configured to be opened and closed, and the upper cover 11 is rotatably connected to the rear side board 13 and is configured to be upwardly opened. The upper cover 11 is upwardly opened to open the box 10 to put at least one package therein. The mailbox also comprises at least one tray 20 movably disposed inside the box 10. The at least one tray 20 is disposed above the movable door 14 and each of the at least one tray 20 is rotatably connected to one of the four side boards 13. At least one link rod mechanism 30 is disposed between the at least one tray 20 and the upper cover 11. The at least one link rod mechanism 30 is linked between the upper cover 11 and the at least one tray 20 to drive the at least one tray 20 to turn or pivot according to movement of the upper cover 11. When the upper cover 11 is opened (i.e., raised up), the upper cover 11 pulls the at least one link rod mechanism 30, so that the at least one link rod mechanism 30 pulls the at least one tray 20 to turned to a first state (e.g., a nearly horizontal state). At this time, the at least one package 40 can be disposed in the box 10 and be supported by the at least one tray 20. When the upper cover 11 is closed, the at least one link rod mechanism 30 pushes the at least one tray 20 to be turned to a second state (e.g., a nearly vertical state), and the at least one package 40 falls into a bottom of the box 10. The movable door 14 is opened to take the at least one package 40 out of the box 10.

In some embodiments, the at least one tray 20 is two trays 20, and the two trays 20 are mirror-symmetrically disposed inside the box 10 in a front and rear direction. The two trays 20 are respectively rotatably connected to the front side board 13 and the rear side board 13.

In some embodiments, each of the at least one link rod mechanism 30 comprises three link rods 31. An inner end of each of the three link rods 31 is pivotally connected together, and an outer end of the three link rods 31 is respectively pivotally connected to a side of the upper cover 11, a side of a first tray 20 of the two trays 20, and a side of a second tray 20 of the two trays 20. A positioning hole 50 is disposed on a middle portion of an upper edge of each of the first lateral side board 13 and the second lateral side board 13. Each of the at least one link rod mechanism 30 is respectively adjacent to the first lateral side board 13 and the second lateral side board 13, and a first link rod 31 of each of the at least one link rod mechanism 30 hinged to the upper cover 11 passes through a corresponding one of the positioning holes 50.

In some embodiments, the at least one link rod mechanism 30 comprises two link rod mechanisms 30, and the two link rod mechanisms 30 are symmetrically disposed on a left side and a right side of the upper cover 11. Preferably, a reinforcing frame 60 is disposed around edges of each of the four side boards 13, and each of the positioning holes 50 is disposed on a corresponding one of the reinforcing frames 60.

In some embodiments, the movable door 14 is disposed on the front side board 13 of the box 10, and the upper cover 11 is rotatably connected to the rear side board 13 of the box 10. Preferably, the movable door 14 comprises a lock 70, and the upper cover 11 comprises a lock. Preferably, the upper cover 11, the bottom board 12, and the four side boards 13 are plastic boards.

Although the present disclosure has been described with reference to the preferred embodiments, it will be apparent to those skilled in the art that various modifications and variations can be made in the present disclosure without departing from the spirit or scope of the invention. Thus, it is intended that the present disclosure cover the modifications and variations of this invention provided they come within the scope of the appended claims and their equivalents.

What is claimed is:

1. A mailbox for storing packages, comprising:

a box, two trays, and at least one link rod mechanism, wherein:

the box is a closed box, the box comprises an upper cover, a bottom board, and a plurality of side boards, a lower portion of one of the plurality of side boards is a movable door configured to be opened and closed, the upper cover is rotatably connected to one of the plurality of side boards and is configured to be upwardly opened, the two trays are mirror-symmetrically disposed inside the box, each of the two trays is rotatably connected to an opposite pair of the plurality of side boards, the two trays are movably disposed inside the box and are disposed above the movable door, the at least one link rod mechanism is disposed between the two trays and the upper cover, each of the at least one link rod mechanism comprises three link rods, inner ends of the three link rods are pivotally connected together, outer ends of the three link rods are respectively pivotally connected to a side of the upper cover, a side of a first tray of the two trays, and a side of a second tray of the two trays, when the upper cover is opened:

the upper cover pulls the at least one link rod mechanism, and the at least one link rod mechanism pulls the two trays to be turned to a first state for loading at least one package, and when the upper cover is closed:

the at least one link rod mechanism pushes the two trays to be turned to a second state for unloading the at least one package.

2. The mailbox for storing packages according to claim 1, wherein:

at least one positioning hole is respectively disposed on a middle portion of an upper edge of at least one of the plurality of side boards, and a first link rod of each of the at least one link rod mechanism hinged to the upper cover passes through a corresponding one of the at least one positioning hole.

3. The mailbox for storing packages according to claim 2, wherein:

a reinforcing frame is disposed around edges of each of the plurality of side boards, and each of the at least one positioning hole is disposed on a corresponding one of the reinforcing frames.

4. The mailbox for storing packages according to claim 1, wherein:

the at least one link rod mechanism comprises two link rod mechanisms, and the two link rod mechanisms are symmetrically disposed on a left side and a right side of the upper cover.

5. The mailbox for storing packages according to claim 1, wherein:

the plurality of side boards comprises four side boards, and each of the two trays is respectively rotatably connected to a front side board and a rear side board of the four side boards.

6. The mailbox for storing packages according to claim 5, wherein:

the movable door is disposed on the front side board, and the upper cover is rotatably connected to the rear side board.

7. The mailbox for storing packages according to claim 1, wherein:

the movable door is comprises a lock, and the upper cover is comprises a lock.

8. The mailbox for storing packages according to claim 1, wherein the upper cover, the bottom board, and the plurality of side boards are plastic boards.

9. The mailbox for storing packages according to claim 1, wherein:

the first state is a horizontal state, and the second state is a vertical state.

* * * * *